United States Patent [19]

Shimizu

[11] 4,324,371

[45] Apr. 13, 1982

[54] APPARATUS FOR CONTROLLING TENSION OF FILAMENT YARN

[75] Inventor: Hichio Shimizu, Fukui, Japan

[73] Assignee: Oda Gosen Kogyo Kabushiki Kaisha, Komatsu, Japan; a part interest

[21] Appl. No.: 203,149

[22] Filed: Nov. 3, 1980

[51] Int. Cl.[3] ..... B65H 59/26; B65H 59/36

[52] U.S. Cl. ..... 242/153; 242/154

[58] Field of Search ..... 242/153, 154, 147 R

[56] References Cited

U.S. PATENT DOCUMENTS

| | | | |
|---|---|---|---|
| 1,508,503 | 9/1924 | Brown et al. | 242/153 X |
| 2,615,656 | 10/1952 | Strake | 242/154 |
| 2,754,071 | 7/1956 | Furst et al. | 242/154 |
| 2,942,803 | 6/1960 | Baumgardner | 242/153 |
| 3,559,916 | 2/1971 | Hilscher | 242/153 X |
| 3,582,012 | 6/1971 | Cocker | 242/153 |
| 3,679,153 | 7/1972 | Griggs, Jr. et al. | 242/153 |

*Primary Examiner*—Stanley N. Gilreath

*Attorney, Agent, or Firm*—Cushman, Darby & Cushman

[57] ABSTRACT

An apparatus for controlling the tension of a filament yarn, especially useful for those filament yarns applied to a warping machine, which apparatus being simple in structure and being provided between the pirn of the filament yarn and a take-up beam and arranged so that the filament yarn released from the pirn is passed through this apparatus longitudinally from one end to the other end thereof on a plurality of rotatable roller-like transverse guide members and also through at least one ring-like guide member movably supported, between two adjacent roller-like transverse guide members, on a fixed longitudinal supporting means positioned lower than the rod-like guide means. When the take-up operation of the beam stops abruptly for any reason, the running filament yarn can be brought to a half simultaneously without no overrun, due to the falling onto the supporting means of the movable ring-like guide member by its own gravity which is of a magnitude enough to allow movements of this guide member during the run of the filament yarn. Thus, the filament yarn is subject to an almost constant tension corresponding to the take-up velocity of the beam both during the run and during the rest. Also, during the run, oily agent and monomer of the filament yarn do not stick to the guide members. Thus, the resulting filament yarn enhances the quality of a product fabric.

5 Claims, 4 Drawing Figures

APPARATUS FOR CONTROLLING TENSION OF FILAMENT YARN

BACKGROUND OF THE INVENTION (a) Field of the Invention

The present invention concerns an apparatus for controlling the tension of a filament yarn, and more particularly it pertains to a tension controlling apparatus which is used for a filament yarn as it is taken out from its associated creel of a warper (warper machine) for being subjected to weaving or to warp-knitting, or taken out from a creel to be directed to circular knitting machine, or to shuttleless loom. The apparatus of the present invention is especially useful for controlling the tension of a filament yarn which serves as a warp for being subjected to warp-knitting.

(b) Description of the Prior Art

Warps for being subjected to warp-knitting are prepared usually in such manner that filament yarns of 600–1100 in number are taken out simultaneously from a corresponding number of pirns or supply packages around which the filament yarns are wound, said pirns being mounted on creels of a corresponding number, respectively, and these filament yarns are taken up on a beam at a speed of about 600 m/min. As is well known, the respective filament yarns which are thus taken out from the pirns are collected, by an appropriate converging means such as a reed before being taken up by the beam, to provide a shape as if it were a continuous web consisting of a number of filament yarns each of which is closely positioned to its adjacently positioned yarns. In order to insure that such great number of filament yarns run in a web-like form, it is necessary that the respective filament yarns are taken up under a uniform tension without causing any uneven portions of tension applied to the running filament yarns.

In order to meet such demand, there have been proposed apparatuses intended to control the occurrence of uneven tension of filament yarns being taken up from pirns. For example, there is the so-called washer type tensioning device which is arranged so that a filament yarn is passed from one end to the other end of the device while travelling, in the midway of the course, around portions of circumferences of adjacently positioned two washers supported on corresponding two shafts which can be varied of their positions. The filament yarn is driven to run under a constant tension while being pressed against portions of the circumferences of these washers. Another known tension-providing device is arranged so that a filament yarn is passed between two crossed comb-like members. The angle of crossing of these comb-like members can be adjusted so that the contact area between the filament yarn and the crossed comb-like members through which the filament yarn is passed is adjusted as required, to thereby keep the tension of the running filament yarn constant. However, these known device invariably are based on a same technical concept that the angle of contact formed by the filament yarn passing from the inlet side to the outlet side of the device relative to the guide members is increased to apply a friction pressure to the running filament yarn, to thereby increase, to a certain degree, the tension of the filament yarn taken out from its supply package or pirn. The known tension regulating device which is based on such technical concept as that described above is intended only to control uneveness in the tension and speed with which the filament yarn is taken out. Therefore, such known devices are considered to be significant in that they invariably provide a system for regulating the tension of an individual filament yarn. However, in the warping of warps for use in warp-knitting, the provision of a uniform tension to all of the filament yarns which may be 600 to 1100 in number is a task which is accompanied by a great deal of difficulty. As is well known, the tension regulating devices of the prior art are provided, usually, with means for adjusting the friction pressure applied to the filament yarn. However, it is not an easy task to provide a uniform tension regulating ability to all of as many as 600 to 1100 tension regulating devices in passing as many filament yarns therethrough. Such difficulty may be associated partly with the difficulty in the feasibility of precision with which the respective tension regulating devices are to be manufactured. However, even where the respective tension regulating devices are provided with adjusting means have specific graduations, this will not warrant that the respective filament yarns are taken out and passed to the beam under a uniform tension.

These known tension regulating devices utilizing friction pressure have the following further drawbacks and inconveniences. As is well known, a filament yarn (multifilament yarn) is applied with an oily agent to improve cohesion and smoothness of the filament yarn. However, in case a tension regulating device of the friction pressure type is used for such filament yarn applied with an oily agent, this oily agent and/or a monomer which is residual in the polymer filament yarn is or are caused to gradually depart from the filament yarn due to friction with the surfaces of the guide members, and they naturally begin to adhere to these surfaces thereof. Accordinly, even when, at the start of operation of each tension regulating device, the degree of contact between the filament yarn and its frictional guiding members in each device is set at a uniform level with the exception that the respective filament yarns will be taken out under a predetermined uniform tension, it will be understood that, at time passes, the contact surfaces of the guide members will become soiled by the oily agent of the departing monomer, so that there will appear a change in the angle of contact or in the area of contact between the respective filament yarns and their associating washers, or there will appear unevenesses in the rotation speed of the washers. Under such circumstances, it is no longer possible to keep the respective filament yarns so as to run at a given uniform constant tension continuously for an extended period of time. Not only that, there could appear unevenesses in the tension and elongation of the filament yarn themselves, so that in case the beam around which the filament yarns are wound is subjected to the production of woven fabric or knitted fabric, there arises the fear that rejectable portions such as streaks can develop in the warps. In addition, the development of static electricity and fluffs in the filament yarns due to the friction applied to the yarns on the tension regulating device cannot be avoided.

It is evident that all of these drawbacks and inconveniences of the prior art tension regulating devices are based on the conception to control, by relying on friction pressure, the tension of the filament yarns which are being taken out. If, however, such friction can be removed at least partially, if not all, such drawbacks and inconveniences would be remarkably improved.

SUMMARY OF THE INVENTION

In order to obviate the aforesaid drawbacks and inconveniences of the prior art, the inventors of the present application made an extensive study and researches based on a concept completely different from that of the prior art, and as a result, they have succeeded in the provision of a tension controlling apparatus of a filament yarn which is taken out from a supply package and is wound around a beam, which apparatus having a very simplified structure, and being able to stand a high-speed running of a filament yarn while keeping the filament yarn under a uniform required minimum tension practically without giving the filament yarn any friction resistance, and being provided with an automatic stopping mechanism of the passage of the filament yarn through the tension controlling apparatus to prevent an over-run of the filament yarn whenever the travel of the filament yarn is brought to a halt for any reason.

It is, therefore, an object of the present invention to provide an apparatus for controlling the tension of a filament yarn which is applied thereon, without causing an excessive frictional pressure to be applied to the filament yarn.

Another object of the present invention is to provide an apparatus of the type described above, which, due to the absence of excessive frictional pressure for the filament yarn applied thereon, does not cause a damage in the filament yarn, and does not generate static electricity therein, and does not cause frictional resistance due to the departing oily agent or monomer or the like from the filament yarn.

Still another object of the present invention is to provide a tension controlling apparatus of the type described above, which is provided with a mechanism for automatically stopping the running filament yarn without causing an over-run, while keeping this yarn under a same tension as that during its running, simultaneously with the stopping of the travel of the filament yarn which is caused for any reason.

DETAILED DESCRIPTION OF THE PREFERRED EMBODIMENT

The tension controlling apparatus for a filament yarn according to the present invention comprises a generally oblong frame; an inlet guide and an outlet guide which are provided at longitudinally opposed ends of the frame for introducing the filament yarn into the apparatus and for discharging it out of the apparatus; at least two, and usually five, rotatable roller-like guides provided on the frame transversely of the direction of passage of the filament yarn; at least one, and usually three, movable ring-like members each being positioned between any two adjacent ones of said rotatable roller-like guides; and a supporting rod provided on the frame under said rotatable roller-like guides to limit the position of the movable ring-like member as it drops from its upwardly flipping position by its own gravity when the running filament yarn comes to a halt for any reason. Furthermore, this apparatus is arranged so that, during the operation, the filament yarn is passed therethrough at a high speed from the inlet guide to the outlet guide, travelling on the upper surface portions of the circumferences of the rotatable roller-like guides while contacting them frequently but only at points, and not at areas, thereof. The ring-like members are caused to flip upwardly away from the filament yarn as their inner circumferential surfaces touch, at points, the running filament yarn due to the force or tension of the running filament yarn which is developed as the filament yarn is taken up by the beam at a high speed. This filament yarn is allowed to run through this apparatus in a rectilinear state without being subjected to any excessive friction with the guide means and the rings. In the event that the filament yarn is caused to be brought to a halt for any reason, the ring-like members will drop downwardly by their own gravity to a position which is limited by the supporting rod, to thereby provide maximum area of contact between the filament yarn and the circumferential surfaces of the rotatable roller-like guide means and with the inner circumferential surfaces of the movable ring-like members.

The tension controlling apparatus of the present invention will hereinafter by described in further detail by referring to the accompanying drawings.

Figure 1:
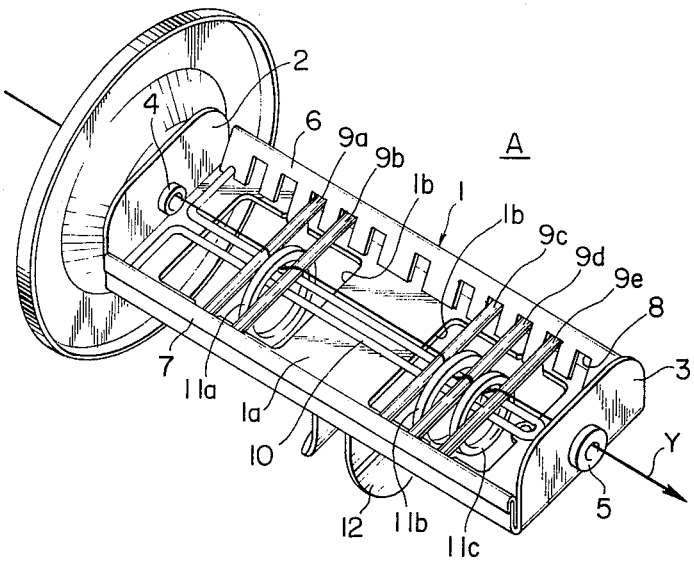
FIG. 1 is a diagrammatic general perspective view of an embodiment of the apparatus for controlling the tension of a filament yarn for use in warping or like machine.

In FIG. 1, the tension controlling apparatus for a filament yarn which is indicated generally by reference symbol A comprises a generally oblong open-top frame 1. This frame is comprised of an oblong base panel 1*a* having two openings 1*b* and 1*b*, one locating in the front portion of the panel 1*a* and the other in a rear portion; end walls 2 and 3 extending upwardly at an angle from the longitudinally opposing ends of this panel 1*a*; an inlet hole 4 and an outlet hole 5 which are formed through substantially the central portions of these end walls 2 and 3, respectively; side walls 6 and 7 extending upwardly at an angle from the opposite side edges of the base panel 1*a* longitudinally thereof; a plurality of recesses 8, 8, . . . provided in each of these side walls 6 and 7 for rotatably receiving the end portion of a plurality of rotatable roller-like guides which will be described later in further detail. The apparatus A of this embodiment has five such roller-like guides 9*a*, 9*b*, 9*c*, 9*d* and 9*e*, and they are inserted at their opposite ends in said recesses 8, 8, . . . . These rotatable rods 9*a*, . . . 9*e* each is an oblong cylindrical or columnar rollers having a circular cross section. The apparatus further has a supporting means 10 supported on the base panel 1*a* of the frame 1 and extending longitudinally of the oblong panel 1*a* substantially along the central portion thereof, as will be described later in further detail. The apparatus still further includes a plurality of movable ring-like members which are provided in a number of three, 11*a*, 11*b* and 11*c*, in this embodiment, all of which are suspended for free movment from said supporting means 10 between two of adjacent rotatable roller-like guides 9*a* and 9*b*, 9*c* and 9*d*, and 9*d* and 9*e*, respectively. The rotatable roller-like guides 9*a*, . . . 9*e* are rotatably supported on said supporting means 10 in such way that the tops of their circular surfaces lie substantially in a horizontal plane to allow a filament yarn to enter from the inlet hole 4 to pass over these rollers and to depart through the outlet hole 5 smoothly and substantially linearly. The apparatus has a pair of lugs 12 extending from substantially the central part of the underside of the base panel 1*a* for being secured to an appropriate part of a warping machine. The frame 1 may be made of any hard metal, and said inlet and outlet holes 4 and 5, said rollers 9*a*, . . . 9*e*, and said rings 11*a*, 11*b* and 11*c* are each made of a material such as alumina porcelain which has been conventionally used as guide members, or they may be made of an electro-conductive ceramic or a conductive light metal. The rings 11*a*, 11*b* and 11*c* each has a circular annular cross section. The inner circumferential surfaces of these ring-like members are formed especially smooth and round to insure smooth contact with the filament yarn which is passed therethrough whenever the filament yarn touches them. It should be understood that each of these ring-like members is arranged so as to be positioned between two adjacent rotatable roller-like guides 9*a*, . . . 9*e*. These ring-like members, needless to say, are freely movable between its associating two adjacent roller-like guides and also about the supporting means 10 on which they are mounted. In case a filament yarn Y which is passed through these ring-like members is at rest, these ring-like members will act so as to press the filament yarn downwardly by their own gravities as the top portions of the inner circumferences of these guides engage the filament yarn. When, however, the filament yarn Y is running at a high speed from the supply package through the tension controlling apparatus toward the beam of the warping machine which will be referred to later, these ring-like members are caused to flip around about the supporting means 10 by the forces or tension of the running filament yarn, and whenever these ring-like members drop onto the running yarn during such flipping movements, the inner circumferential surfaces of the rings contact, at points and not in area, the filament yarn, as will be described later in further detail. When the filament yarn is at rest, the ring-like members drop for a distance which is limited by the supporting means 10 which, in turn, is carried on the base panel 1*a* of the frame 1. Thus, these rings are prevented from undergoing a fall or drop for an excessive distance. This supporting means 10 is made, usually, of a metal wire which is bent substantially into a U-shape, and this U-shaped wire extends to the longitudinally opposing ends of the base panel 1*a* of the frame 1 and secured thereat to this frame. It should be understood that the configuration of this supporting means 10 is not limited to that illustrated, but many other shapes may be considered without departing from the spirit of the present invention.

Figure 2:
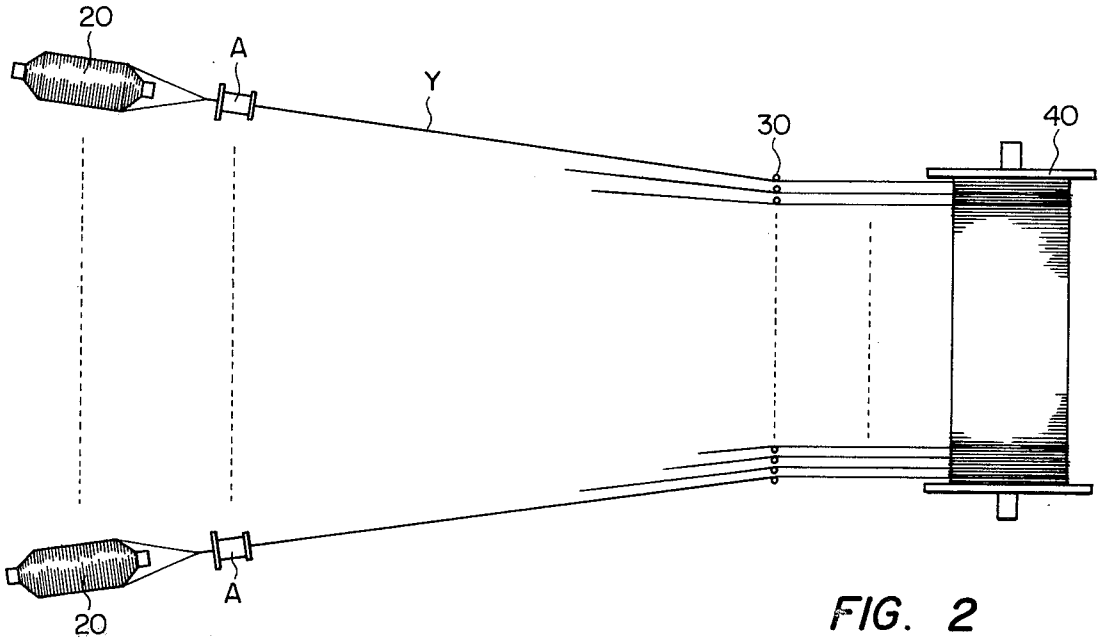
FIG. 2 is a diagrammatic explanatory plan view of a warping machine employing the apparatuses of the present invention.

In order to have a better understanding of the present invention, hereunder will be briefly described the outline of the warping machine in which the apparatuses of the present invention are used. FIG. 2 is a diagrammatic, explanatory plan view of a warping machine, in which 600 to 1100 pirns or filament yarn supply packages 20, 20, . . . are arranged in a known manner. Filament yarns taken out from the respective pirns are collected and converged by means such as a reed 30 into a sheet or web-like form, and they are wound around a beam 40. The tension controlling apparatuses of the present invention are provided at the take-out side of the filament yarns of the respective pirns so that each filament yarn from each pirn is passed through its mating tension controlling apparatus which is positioned about 20 cm ahead from end of the pirn which is located away from the creel not shown on which the pirn is rotatably mounted. The reed 30 is provided between the supply package side and a beam 40 to converge the respective filament yarns taken out from the respective pirns into a web-likeform so as to be wound around the beam 40. Such warping machine is widely known, so that its detailed explanation is omitted.

Figure 3:
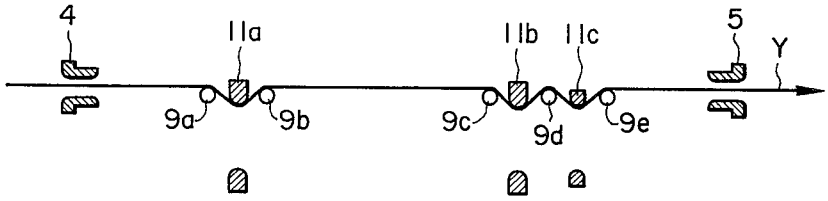
FIG. 3 is a diagrammatic explanatory illustration showing the positional relationship of the rod-like guide means and ring-like members relative to the filament yarn on the apparatus of FIG. 1 when the filament yarn is at rest.
Figure 4:
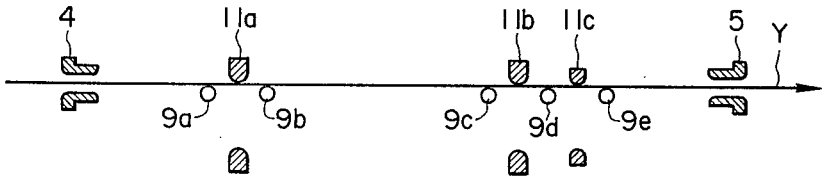
FIG. 4 is a diagrammatic explanatory illustration showing the positional relationship of the rod-like guide means and ring-like members relative to the filament yarn on the apparatus of FIG. 1 when the filament yarn is running.

In operation of the warping machine, the beam 40 is driven to start the take-up of the web-like filament yarns. Whereupon, the filament yarns are subjected to a slightly tensioned state during the run by the pulling force applied to the filament yarns. As each filament yarn is passed through its mating tension controlling apparatus A, the respective ring members 11*a*, 11*b* and 11*c* are caused to flip upwardly by the running force or tension of the filament yarn as it is rendered to a tension state from the sunken or depressed state shown in FIG. 3 which is a state brought about when the filament yarn Y is at rest. During the rung of the filament yarn, these rings would frequently be caused to flip upwardly in general, departing from their momentary contacts with the running filament yarn Y at a point, and would then momentarily drop onto the filament yarn again, and would contact the yarn momentarily at a point of the inner circumferential surfaces of the rings. Then, the rings will flip generally upwardly again and will drop onto the filament. These actions will be repeated, as if the rings are vibrating. On the other hand, the filament yarn Y will run smoothly at a high speed under a slight tension on the rotatable roller-like guides 9*a*, . . . 9*e*. Whenever the running filament yarn Y contacts the upper surfaces of the rotatable roller-like guide means, the filament yarn makes a point-contact therewith, and not area contact. In this way, the filament yarn Y travels, at a high speed, substantially rectilinearly through the inlet hole 4 to the outlet hole 5 and therefrom to the reed 30, as shown in FIG. 4. During the run of the filament yarn through the apparatus of the invention, the top portion of the inside circumferential surface of each of the ring-like guides 11*a*, 11*b* and 11*c* and the top surface of each of the rotatable roller-like guide means 9*a*, . . . 9*e* are aligned in a same plane in such manner as shown in FIG. 4, excepting the instances wherein the ring-like guides are caused to flip generally upwardly away from this plane. This means that the top portion of the inner circumferential surface of these ring-like guides do not fall down beyond said plane. In order to warrant such operational relationship as mentioned above between the running filament yarn and the ring-like members, it is necessary that each of the ring-like members 11*a*, 11*b* and 11*c* has such weight that the total weight of all of the rings are chosen to insure that the rings will be caused to flip upwardly away from the plane due to the tension of the running filament yarn which tension, in turn, is developed as the filament yarn is taken up by the beam 40. In other words, in case the traveling speed of the filament yarn Y is zero or negligible, the angle of contact between the filament yarn Y and the rotatable roller-like guide means 9*a*, . . . 9*e* and the ring-like guide members 11*a*, 11*b* and 11*c* will increase as the angle with which the yarn departs from a straight line increases, causing the frictional pressure imparted to the filament yarn Y to increase. In contrast thereto, in case the filament yarn Y starts to run at a substantial speed, the respective ring-like guide members are caused to flip generally upwardly away from said plane and the path of travel of the yarn will become rectilinear which is a contact at point. Thus, the filament yarn Y is rendered to become a rectilinear line from the inlet guide 4 through to the outlet guide 5, and the frictional pressure applied to the filament yarn becomes minimum. During the run of the filament yarn, the ring-like guide members 11*a*, 11*b* and 11*c* which are freely rotatable are caused to flip around and rotate freely in a vibrating manner. Thus, the oily agent and the monomer of the running filament yarn Y which could be transferred onto the inner circumferential surfaces of these rings are shaken off from these surfaces due to the vibrating movements of the rings. Accordingly, these oily agent and monomer do not stick to a certain portion of each ring and do not accumulate thereon. This applies true to the rotatable roller-like guide members also. These rollers are rotated at a high speed as the filament yarn Y passes thereon, and a same effect as that described just above takes place. As a result, there is found an interesting fact that all of the guide means can be maintained constantly clean.

The tension-controlling apparatus shown in FIG. 1 represents a preferred embodiment. It should be understood that the manner of combination as well as the number of the rotatable roller-like guide members 9*a*, . . . 9*e* and the ring-like guide members 11*a*, 11*b* and 11*c* are not limited to those illustrated. For example, it suffices to provide only two rotatable roller-like guide members 9*a* and 9*b* and only one rotatable ring-like guide member 11*a* therebetween, to sufficiently achieve the aimed functions described above, so long as there is established a positional and operational relationship between these guide members similar in principle to that described above in connection with FIG. 1.

The tension-controlling apparatus shown in FIG. 1 illustrates the structure which exhibits a very effective tension controlling function when employed for the performing of warping by the use, as a warp for warp-knitting, of a polyester filament yarn of 15–20 denier to run at a speed of 600 m/min.

The arrangement particulars of the apparatus shown in FIG. 1 are: the distance between the inlet guide 4 and the outlet guide 5 is 8.0 cm; the length of each of the rotatable roller-like guides 9*a*, . . . 9*e* is 3.2 cm and its diameter is 2.5 mm; the interval between the respective two adjacent roller-like guides 9*a*–9*b*, 9*c*–9*d* and 9*d*–9*e* is set at 4.0 mm; the ring-like guides 11*a* and 11*b* each has an outer diameter of 2.1 cm and an inner diameter of 1.4 cm and a weight of 2.0 g; and the ring-like guide 11*c* has an outer diameter of 1.8 cm and an inner diameter of 1.3 cm and a weight of 1.2 g. With such arrangement particulars as mentioned above of the guide means, it will be noted that among the three ring-like guide members, the one 11*c* has a weight slightly smaller than that of the other two. This is because of the discovery that a good result if obtained, in repeated various tests, from the arrangement of the three ring-like guide members in the manner as shown, i.e. in the relation: 11*a* (the one closest to the inlet side)$\geqq$11*b* (the intermediate one)$>$11*c* (the one closest to the outlet side), though the reason for the good result from such specific arrangement has not been elucidated yet.

Generally, the size and weight of the respective guide means may be varied arbitrarily as required depending on the size, property and travel speed of a filament yarn which is to be subjected to a warping machine. It should be understood, however, that the tension-controlling apparatus according to the present invention is not intended, in principle, to impart a tension to the filament yarn as will be understood by reading this specification. Therefore, this apparatus does not require, unlike the known tension-adjusting devices, any re-adjustment of the parts of the apparatus or changing of the setting of tension to be applied to a certain type of filament yarn to a different tension for a filament yarn of a different type. The above-mentioned numerical values for the parts of a preferred embodiment of apparatus and the size or denier of filament yarn may be regarded as representing the standard general values required for ordinary warping.

As will be understood from the foregoing statement, a filament yarn which is applied to a warping machine is introduced into the tension-controlling apparatus of the present invention through the inlet guide 4, and is passed on the respective rod-like rotatable guide members 9*a*, . . . 9*e*, and through the ring-like movable guide members 11*a*, . . . 11*c* which are movably suspended on the supporting means 10 between two adjacent rod-like guide members, and is taken out from the outlet guide 5 to be supplied to the beam 40 to be wound therearound via a reed 30 which is intended to converge a number of filament yarns into a web-like shape. The filament yarn Y is caused to run through this apparatus at a speed corresponding to the take-up velocity of the beam 40. Since the beam 40 is of a known type, its detailed description is omitted.

As has been described above, according to the present invention, it will be understood that, however much the travel velocity of the filament yarn may be, increased, the filament yarn is able to contact the respective guide members only in a minimum area, i.e. point contact, whenever a contact takes place therebetween, so that the filament yarn can be taken up by the beam under required minimum tension. Also, in case the run of the filament yarn is interrupted or suspended for any reason, the filament yarn is instantaneously inhibited of its run without any over-run, by virtue of the automatic travel-stopping function provided by the downward falling of the movable ring-like guide means due to their own gravities. Along therewith, slacking of the filament yarn which could develop during its travel from the creel to the beam of a warping machine can be absorbed by virtue of said automatic stopping function, so that the running filament yarn can be brought to a halt abruptly in such manner that the tension which has been applied to the filament yarn during the run is not altered when it is abruptly rendered to the rest state. Thus, the tension-controlling apparatus according to the present invention is useful in enhancing the operational efficiency at the time of resuming the warping operation from the suspended or inoperative state and, accordingly, in securing good quality of the textile or fabric made with the filament yarns having been applied to the apparatuses of the present invention, due to the absence of sticking and/or entanglement between the respective filament yarns during their run in a web-like form toward the beam. Furthermore, since the tension-controlling apparatus according to the present invention does not rely on the friction-pressure system of the prior art, there arise no such troubles as loss of cohesion of multifilament, breach of filament yarn, development of fluffs and generation of static electricity. In addition, the tension-controlling apparatus per se can have a simplified structure and an increased service life.

What is claimed is:

1. An apparatus for controlling the tension of a filament yarn, provided between a pirn of the filament yarn and a take-up especially in a warping machine to allow the filament yarn to start its run and to continue its run with substantially the same required minimum tension as that which the filament yarn has during its rest state, comprising:

a generally oblong frame;

an inlet guide and an outlet guide provided at longitudinally opposed ends of said frame, through which a running filament yarn is introduced in and discharged out from said apparatus during a warping operation, a plurality of rotatable roller-like guide means provided rotatably on the frame transversely of the direction of passage of the filament yarn for supporting the filament yarn at a topmost portion of the circumference of each of said roller-like guide means as the filament yarn passes through the apparatus, at least three movable ring-like members each being positioned between any two adjacent ones of said rotatable roller-like guide means, through which is passed a filament yarn, said three ring-like members being spaced along the path of travel of the filament yarn with the member closest the inlet guide being equal to or greater than the weight of the intermediate ring-like member and with said intermediate ring-like member being of greater weight than the ring-like member located closest to said outlet guide of said apparatus, and a supporting means provided on the frame under said rotatable roller-like guide means to limit the lowest position of said movable ring-like members as the running filament yarn comes to a halt, said lowest position of said ring-like members being defined by that topmost portion of the inner circumference of each ring-like member which is lower than the topmost portions of the circumferences of the rotatable roller-like guide means, the topmost portion of the circumferences of the roller-like guide means being aligned in a horizontal plane to allow the filament yarn to pass through the apparatus horizontally and rectilinearly during the warping operation.

2. An apparatus according to claim 1, wherein said frame comprises:

an oblong base panel provided with a front opening and a rear opening;

end walls extending upwardly from longitudinally opposing ends of said base panel and being provided with said inlet and outlet guides, respectively;

side walls extending upwardly from opposite ends of said base panel longitudinally thereof; and a plurality of recesses provided in each of said side walls for rotatably receiving end portions of said roller-like guide means.

3. An apparatus according to claim 1, wherein said ring-like members have such weight as is caused to flip around said supporting means due to a tension of the running filament yarn.

4. An apparatus according to claim 1, wherein said ring-like members and said roller-like guide means are made with an alumina porcelain having smooth surfaces.

5. An apparatus according to claim 1, wherein said filament yarn is a man-made filament yarn of 15–20 denier.

* * * * *